United States Patent [19]

Merkel et al.

[11] Patent Number: 4,973,535

[45] Date of Patent: Nov. 27, 1990

[54] PHOTOGRAPHIC RECORDING MATERIAL COMPRISING A DYE IMAGE-FORMING COUPLER COMPOUND

[75] Inventors: Paul B. Merkel; David J. Giacherio, both of Rochester, N.Y.

[73] Assignee: Eastman Kodak Company, Rochester, N.Y.

[21] Appl. No.: 231,331

[22] Filed: Aug. 12, 1988

Related U.S. Application Data

[63] Continuation-in-part of Ser. No. 99,176, Sep. 21, 1987, abandoned.

[51] Int. Cl.[5] ..... G03C 7/32; G03C 7/34; G03C 7/38

[52] U.S. Cl. ..... 430/17; 430/359; 430/377; 430/543; 430/546; 430/551; 430/552; 430/553; 430/555; 430/558

[58] Field of Search ..... 430/377, 359, 543, 546, 430/551, 552, 553, 555, 558, 17

[56] References Cited

U.S. PATENT DOCUMENTS

| | | | |
|---|---|---|---|
| 2,353,262 | 7/1944 | Peterson et al. | 430/546 |
| 3,676,137 | 7/1972 | Mizuki et al. | 430/546 |
| 4,474,873 | 10/1984 | Maekawa et al. | 430/546 |
| 4,584,264 | 4/1986 | Ohki et al. | 430/551 |

FOREIGN PATENT DOCUMENTS

| | | | |
|---|---|---|---|
| 0147009 | 3/1981 | Fed. Rep. of Germany | 430/546 |
| 0204041 | 11/1984 | Japan . | |
| 0524554 | 8/1940 | United Kingdom . | |

OTHER PUBLICATIONS

J. of American Chemical Soc., 73, 919, 1951.

*Primary Examiner*—Richard L. Schilling
*Attorney, Agent, or Firm*—Richard E. Knapp

[57] ABSTRACT

This invention relates to a color photographic silver halide recording material containing a dye image-forming coupler compound and a sulfonamide compound which is capable of altering the spectral absorption properties of a dye formed by reaction of the coupler compound with oxidized developing agent.

19 Claims, No Drawings

PHOTOGRAPHIC RECORDING MATERIAL COMPRISING A DYE IMAGE-FORMING COUPLER COMPOUND

This is a continuation-in-part of U.S. patent application Ser. No. 099,176 filed Sept. 21, 1987, now abandoned.

This invention relates to a color photographic silver halide recording material. In particular, the invention relates to an improved photographic recording material comprising a dye image-forming coupler compound.

Color photographic recording materials generally contain silver halide emulsion layers sensitized to each of the blue, green and red regions of the visible spectrum, with each layer having associated therewith a color forming compound which, respectively, yields a yellow, magenta or cyan dye. The quality of the resulting color image is primarily based on the dye hues obtained from the respective color forming compounds.

Dye image forming coupler compounds are frequently employed to provide desired color images. A problem encountered with such couplers is that the spectral absorption characteristics of dyes obtained therefrom may not be in the particular narrow region where absorption is most desired. Frequently, the hue which is obtained may be as little as several nanometers removed from the optimum desired absorption value, and therefore be rejected for commercial use notwithstanding this slight difference. Conversely, a resulting dye may have an absorption maximum which is considerably shorter than a desired value.

Attempts to alter absorption characteristics of dyes obtained from dye image forming coupler compounds are usually focused on alterations of the structures of coupler compounds. This approach, while enjoying some measure of success, is not only time consuming, but also involves the expense of highly focused research programs. Success with such programs is not predictable so that improvements in final hue values have been elusive, even after concentrated research efforts.

Some coupler solvents are known to cause shifts in absorption values of dyes. For example, U.S. Pat. No. 3,676,137 describes use of a phosphate ester of a high boiling coupler solvent to shift absorption of a cyan dye to a shorter wavelength in order to reduce excessive red wavelength absorption. Alternatively, shifting absorption of a pyrazolone azomethine dye to a longer wavelength by use of a phenolic compound is known from *Journal of the American Chemical Society,* 73, 919 (1951).

Japanese patent publication No. 59(1984)-204041 describes use of sulfamide compounds, having the group

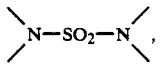

with cyan dye image-forming couplers to shift the absorption maxima to longer wavelengths without widening the ½ band width; to improve light fastness; to reduce unwanted green absorption and to reduce loss of density caused by bleach operations in dyes obtained from such couplers. This publication also suggests addition of other compounds that form dyes by oxidative coupling with primary amine color developing agents, such as magenta and yellow coupler compounds. However, there is no teaching or suggestion in this publication that a sulfonamide compound can be used to alter absorption characteristics of dyes derived from dye image-forming couplers or that particular compounds employed in the present invention would be useful for this purpose.

Accordingly, there is a need for a color photographic silver halide recording material having the capability of imparting slight as well as relatively large alterations in the absorption properties of a dye to obtain a desired spectral absorption which is different from the inherent absorption characteristics of the dye.

A color photographic recording material according to this invention comprises a support having thereon a light sensitive silver halide emulsion layer, a dye image-forming coupler capable of forming a dye by reaction with oxidized color developing agent and associated with the coupler, a sulfonamide compound which is capable of altering the spectral absorption of a dye formed from the coupler, said sulfonamide compound having the structural formula:

$$R^1SO_2NHR^2$$

wherein:

$R^1$ and $R^2$ are alkyl having from 1 to about 20 carbon atoms or phenyl which may be substituted with alkyl having from 1 to about 4 carbon atoms or with sulfamoyl having the formula $—SO_2NHR^3$, where $R^3$ is alkyl of from 1 to about 12 carbon atoms, or with halogen, wherein at least one of $R^1$ or $R^2$ is phenyl.

This invention also relates to a color photographic record comprising a dye formed by a coupling reaction between a dye image-forming coupler and oxidized silver halide developing agent, which recording material comprises, in association with the dye, a sulfonamide compound having the structural formula:

$$R^1SO_2NHR^2$$

wherein;

$R^1$ and $R^2$ are alkyl having from 1 to about 20 carbon atoms or phenyl which may be substituted with alkyl having from 1 to about 4 carbon atoms or with sulfamoyl having the formula $—SO_2NBHR^3$, where $R^3$ is alkyl of from 1 to about 12 carbon atoms, or with halogen, wherein at least one of $R^1$ or $R^2$ is phenyl.

Alkyl groups which are represented by $R^1$ and $R^2$ can be straight or branched chain. The alkyl groups preferably comprise from 1 to about 12 carbon atoms.

The type of substituents which can be present on the alkyl groups include hydroxy; halogen, particularly chlorine or bromine or $—SO_2R^3$, where $R^3$ is as defined above.

Chlorine is a preferred halogen substituent on an $R^1$ or $R^2$ phenyl or alkyl group inasmuch as it provides food stability properties and is relatively inexpensive from a manufacturing consideration.

The described sulfonamide compounds are readily synthesized by reacting a sulfonyl chloride compound of the formula $R^1SO_2Cl$ with ammonia or with a primary amine compound of the formula $R^2NH_2$, according to procedures of the formula art. $R^1$ and $R^2$ have the meanings as described above.

There are no particular restrictions on the quantity of a sulfonamide compound which can be employed with a dye image forming coupler either alone or in combination with known coupler solvents. Generally, it is desirable that the quantity of sulfonamide compound, with respect to each part by weight of coupler, be from about 0.05 to about 10 parts, preferably from about 0.2 to about 3 parts by weight of coupler compound. As the amount of sulfonamide compound increases, relative to the amount of coupler compound employed, there is usually a detectable increase in the extent of hue shift in the dye. However, the particular choice of coupler, of sulfonamide compound or the presence of one or more coupler solvents, all tend to influence the type and the extent of spectral absorption change in the resulting dye.

When the coupler compound is added to a silver halide emulsion, conventional procedures may be employed. For example, the coupler can first be dissolved in one or more known coupler solvents, such as di-n-butyl phthalate (DBp), and then be mixed with a sulfonamide compound as described herein. If desired, the coupler compound can be mixed with a sulfonamide compound, where these compounds are sufficiently compatible, so that known coupler solvents may not be needed. The resulting mixture or solution is then dispersed in aqueous gelatin, preferably containing a surfactant, and the dispersion is added to a silver halide emulsion which can then be coated by known techniques.

Specific sulfonamide compounds which are useful for shifting absorption values of dyes obtained by the reaction of dye image forming coupler compounds with oxidized color developing agents include the following:

1.

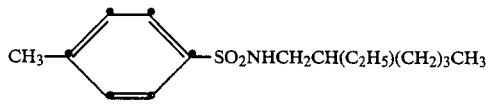

2.

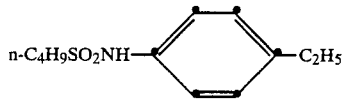

3.

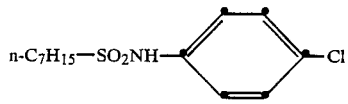

4.

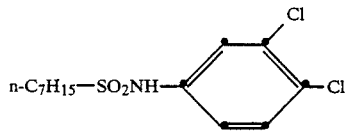

5.

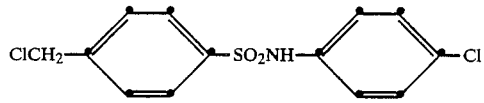

6.

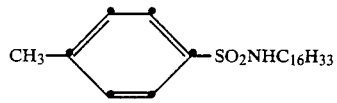

7.

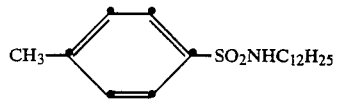

8.

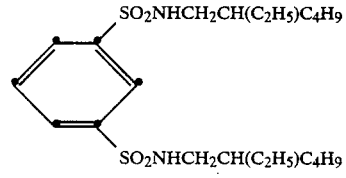

9.

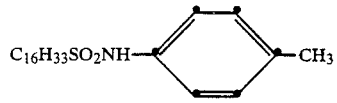

-continued

10.

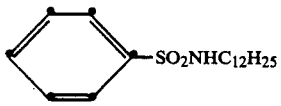

11.

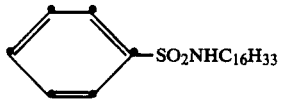

12.

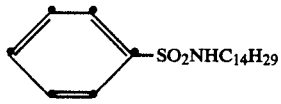

13.

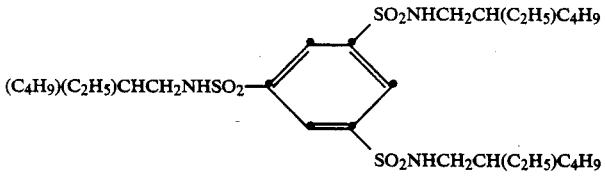

14.

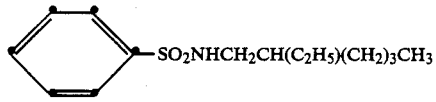

Couplers which form cyan dyes upon reaction with oxidized color developing agents are described in such representative patents and publications as U.S. Pat. Nos. 2,474,293; 2,772,162, 2,801,171; 2,895,826; 3,002,836; 3,419,390; 3,476,563; 3,779,763; 3,996,253; 4,124,396; 4,248,962; 4,254,212; 4,296,200; 4,333,999; 4,443,536; 4,457,559; 4,500,635 and 4,526,864, the disclosures of which are incorporated herein by reference.

Preferred cyan coupler structures are phenols and naphthols which form cyan dyes on reaction with oxidized color developing agent. These preferred structures include the following moieties;

C-1

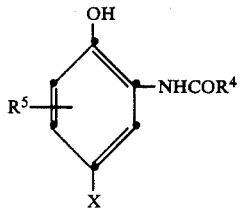

C-2

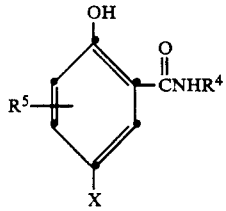

C-3

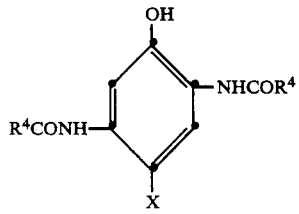

-continued

C-4

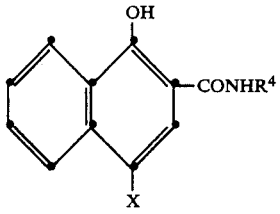

where $R^4$ represents a ballast group, $R^5$ represents one or more halogen atoms (e.g., chloro, fluoro), lower alkyl (e.g., methyl, ethyl, butyl) or lower alkoxy (e.g., methoxy, ethoxy, butoxy) groups and X is hydrogen or a coupling off group. An especially preferred $R^4$ group is a p cyanophenyl substituted amino group such as is described in U. S. Pat. No. 4,333,999.

Couplers which form magenta dyes upon reaction with oxidized color developing agents are described in such representative patents and publications as: U.S. Pat. Nos. 1,969,479; 2,311,082; 2,343,703; 2,369,489; 2,600,788; 2,908,573; 3,061,432; 3,062,653; 3,152,896; 3,519,429; 3,725,067; 4,120,723; 4,500,630; 4,540,654 and 4,581,326; and European Patent Publication Nos. 170,164 and 177,765; and copending U.S. application Ser. Nos. 23,517 of S. Normandin et al; 23,518 of R. Romanet et al; 23,519 of A. Bowne et al and 23,520 of A. Bowne et al, all filed Mar. 9, 1987, the disclosures of which are incorporated herein by reference.

Preferred magenta couplers include pyrazolones compounds having the structural formulae:

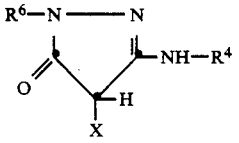

-continued and

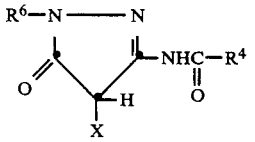

pyrazolotriazole compounds having the structural formulae:

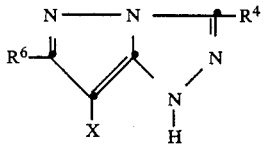

and

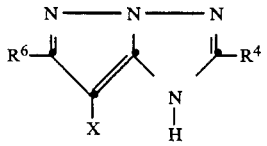

pyrazolobenzimidazole compounds having the structural formulae:

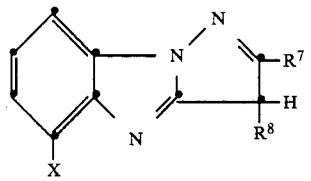

and

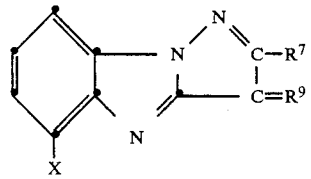

and indazole compounds having the structural formula:

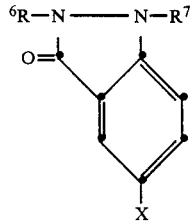

wherein

X is as defined above;

$R^4$ is a ballast group;

$R^6$ is halogen (e.g., chloro, fluoro), alkyl or alkoxy having from 1 to 4 carbon atoms, phenyl or substituted phenyl (e.g., 2,4,6-trihalophenyl);

$R^7$ is hydrogen or a monovalent organic radical, for example a saturated or unsaturated alkyl group having from 1 to about 20 carbon atoms (methyl, ethyl, propyl, butyl, decyl, dodecyl, heptadecyl, octadecyl); a cycloalkyl group (e.g. cyclohexyl); an aralkyl group (e.g. benzyl); an aryl group (e.g. phenyl, alkoxyphenyl in which the alkyl or alkoxy radical has from 1 to about 20 carbon atoms, nitrophenyl, aminophenyl, acylaminophenyl, alkylaminophenyl, naphthyl, diphenyl, diphenylether, diphenylthioether); a heterocyclic group (e.g. α-furyl, α-benzofuryl, α-pyridyl); an amino, hydroxy or carboxylic acid group, it being possible for the hydrogen atoms of these groups to be substituted, for instance by a mono- or dialkylamino group in which the alkyl groups have from 1 to about 20 carbon atoms; a cycloalkylamino group; an amino group in which one hydrogen atom is replaced by a pyrazolo [1,5 a]-benzimidazolyl radical which is bonded in 3 position to said nitrogen atom so that couplers result in which two pyrazolo [1,5 a]-benzimidazolyl radicals are connected by an amino group, and in which the remaining hydrogen atom may be replaced by a substituent such as an alkyl-, aryl-, aralkyl- or acyl- radical; an acylamino group in which the acyl radical is derived from an aliphatic, aromatic or heterocyclic carboxylic acid; a carboxylic acid group which is esterified by means of an aliphatic, cycloaliphatic or aromatic alcohol or by an aromatic compound having a phenolic hydroxy group; or a carboxyamido group in which the amido group may be substituted for example by a saturated or unsaturated alkyl, aralkyl, aryl or heterocyclic group;

$R^8$ represents a hydrogen atom, a sulphonic acid or a carboxylic acid group; a halogen atom (e.g. chlorine or bromine); or an azo radical —=$NR^{13}$, wherein $R^{13}$ can be an aromatic or heterocyclic radical (phenyl, naphthyl, diphenyl, diphenylether, benzthiazolyl, pyridyl, quinolyl or pyrazolyl) which may be substituted such as by an alkyl group having from 1 to about 20 carbon atoms, hydroxy, alkoxy, halogen, amino, substituted amino, nitro, sulphonic acid or carboxylic acid groups;

$R^9$ represents a divalent radical such as

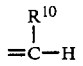

wherein $R^{10}$ can be alkyl, aralkyl, especially phenyl, phenyl substituted preferably in the p-position by a tertiary amino group such as a dialkylamino group in which at least one of the alkyl groups is substituted by carboxy, sulpho, hydroxy, alkoxy, carboxylalkyl, cyano or the divalent radical

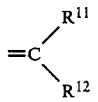

wherein $R^{11}$ and $R^{12}$ represent aliphatic, aromatic, araliphatic or heterocyclic radicals.

Specific magenta dye forming coupler compounds which are useful in the practice of this invention include:

M-1
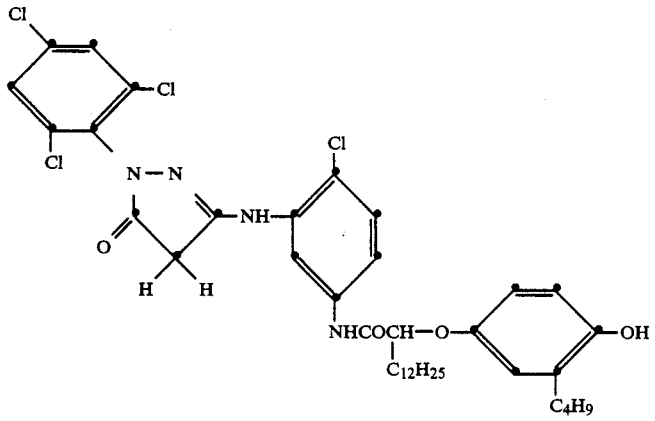
M-2
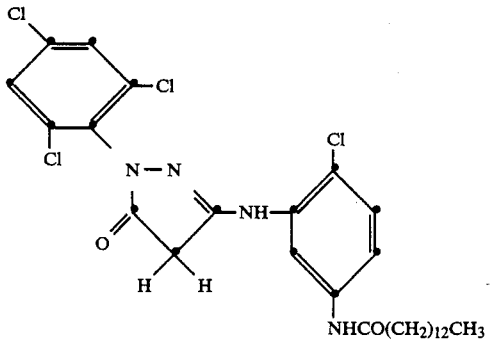
M-3
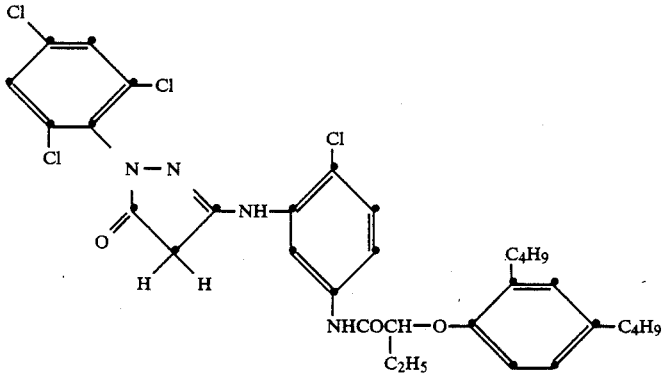
M-4
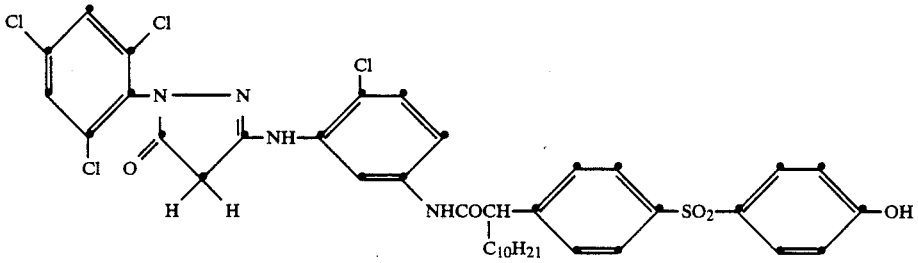

-continued
M-5
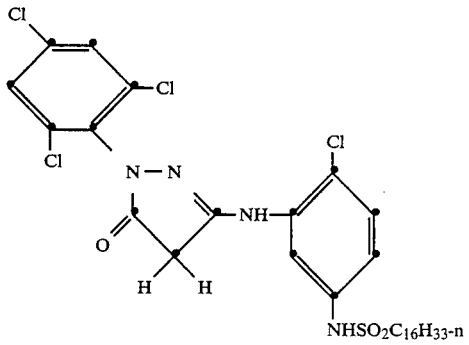
M-6
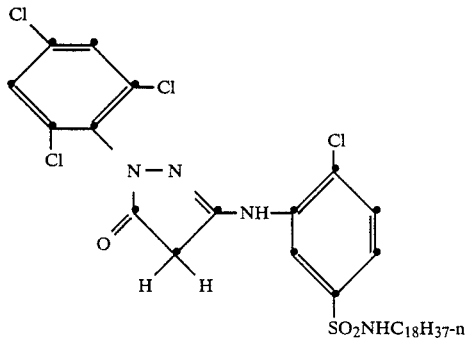
M-7
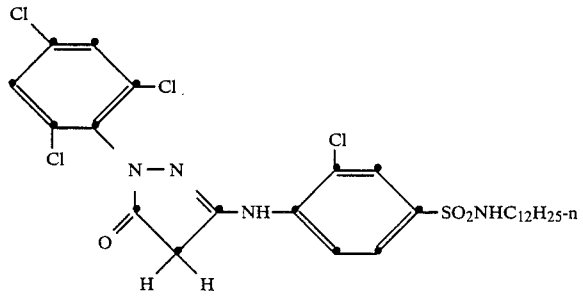
M-8
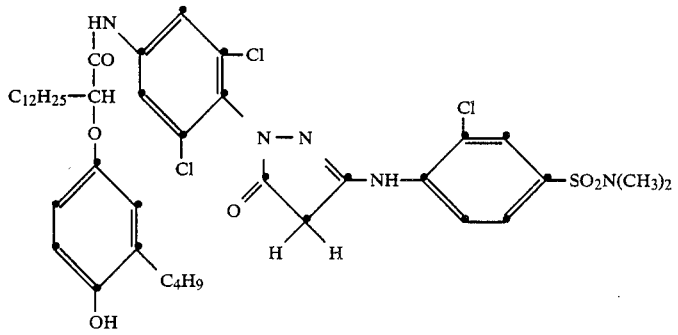

-continued
M-9
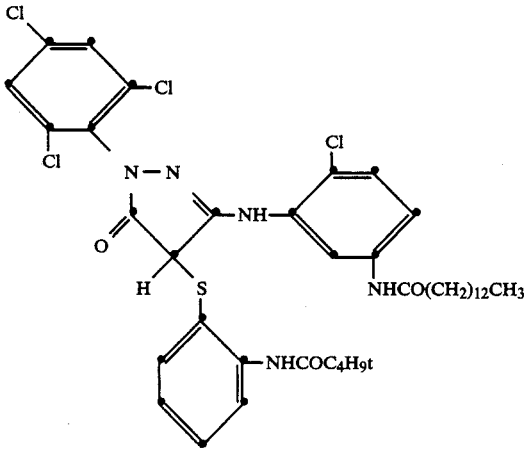
M-10
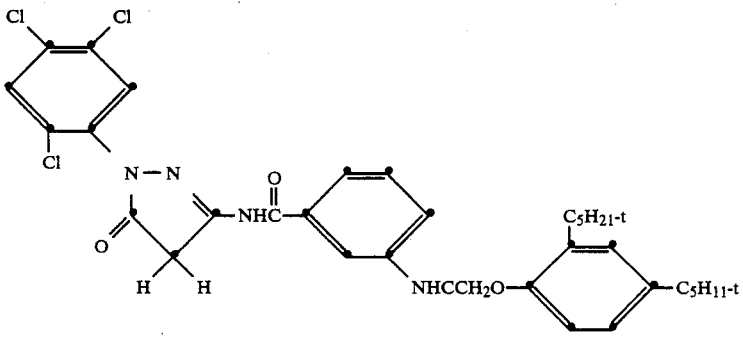
M-11
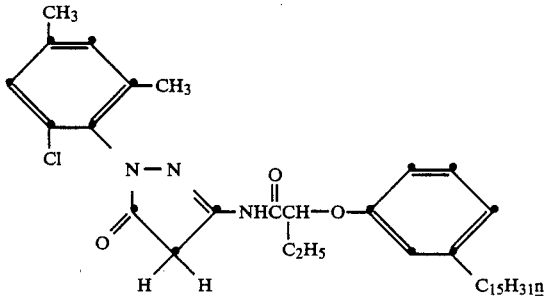
M-12
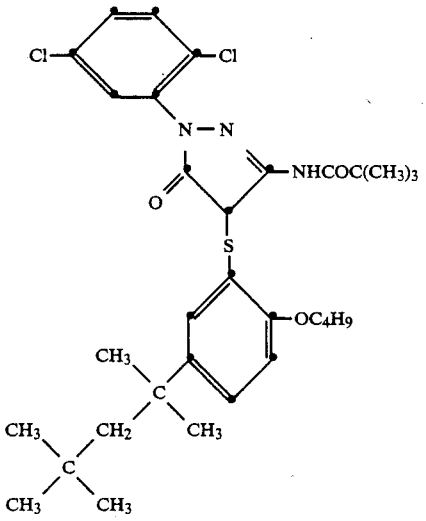

-continued
M-13
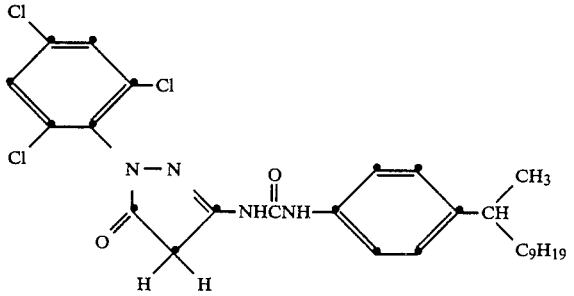
M-14
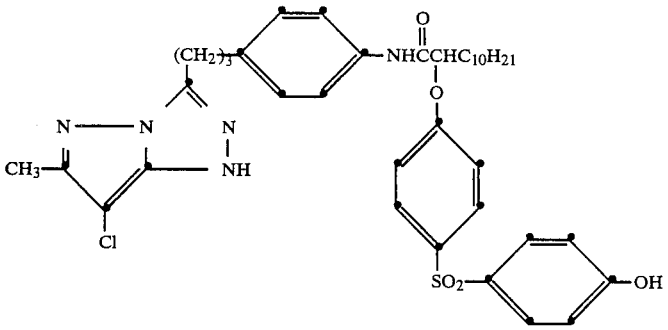
M-15
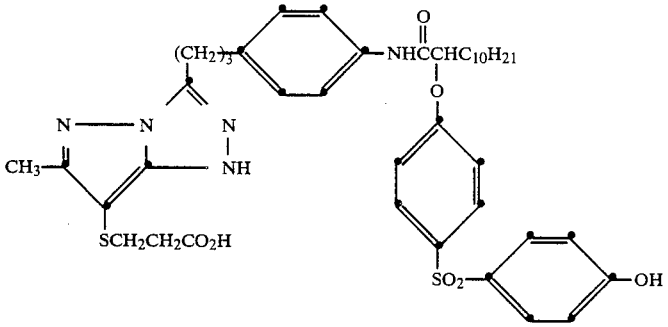
M-16
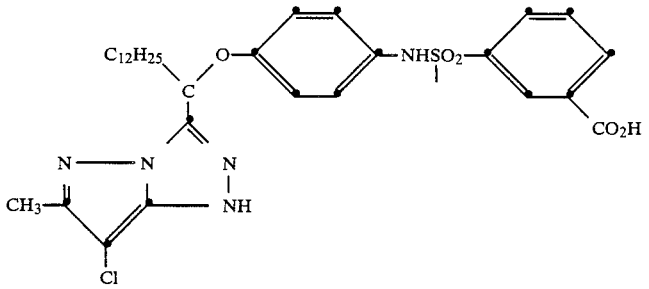
M-17
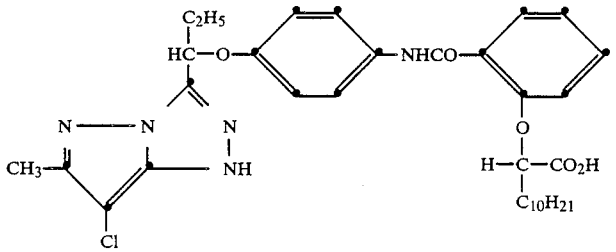

-continued
M-18
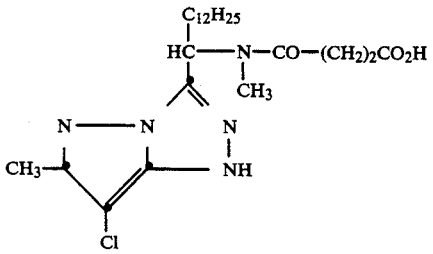
M-19
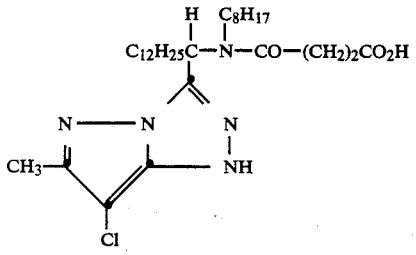
M-20
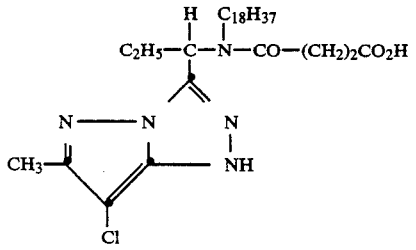
M-21
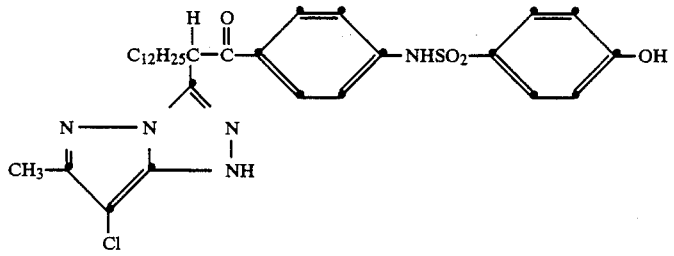
M-22
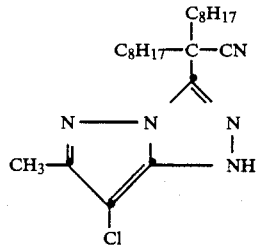
M-23
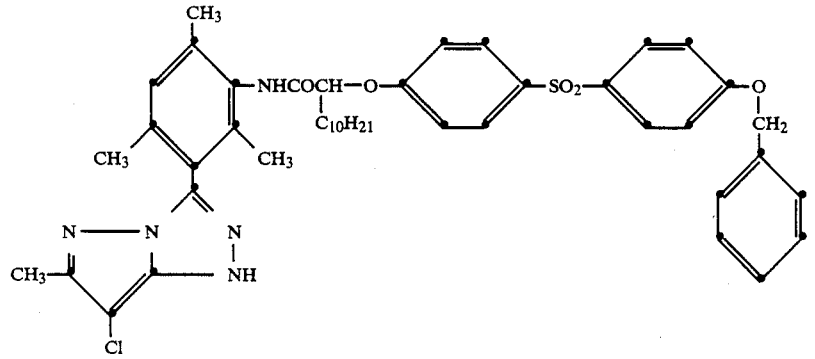

-continued
M-24
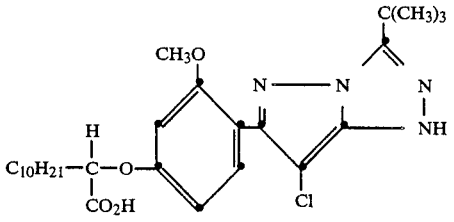
M-25
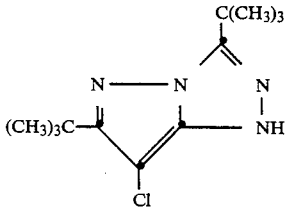
M-26
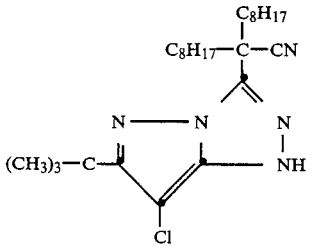
M-27
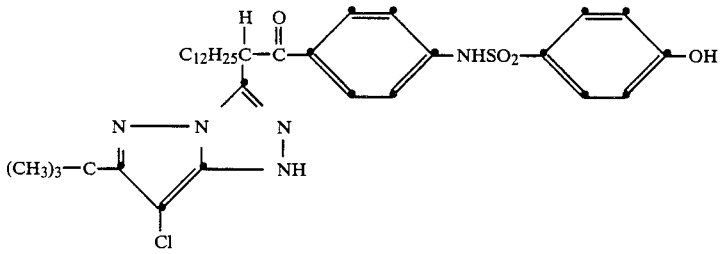
M-28
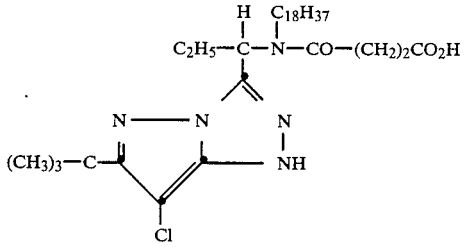
M-29
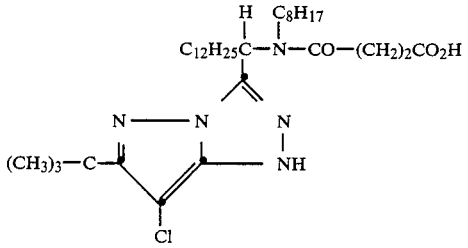

-continued
M-30
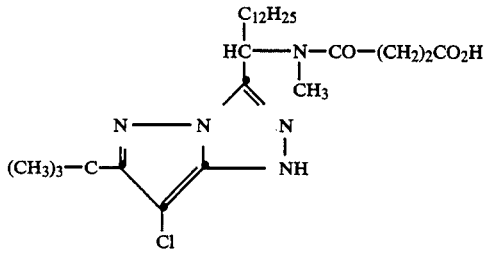
M-31
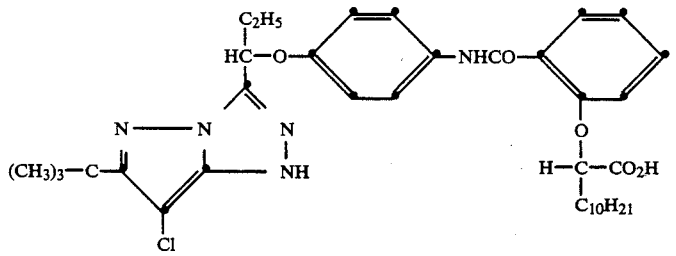
M-32
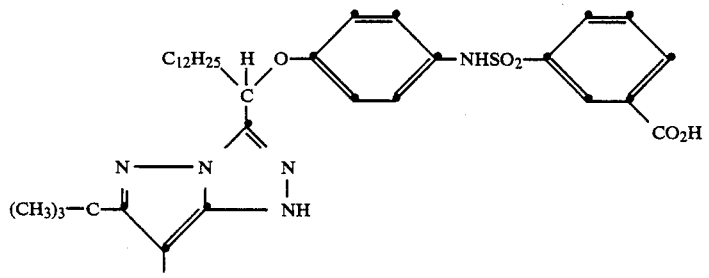
M-33
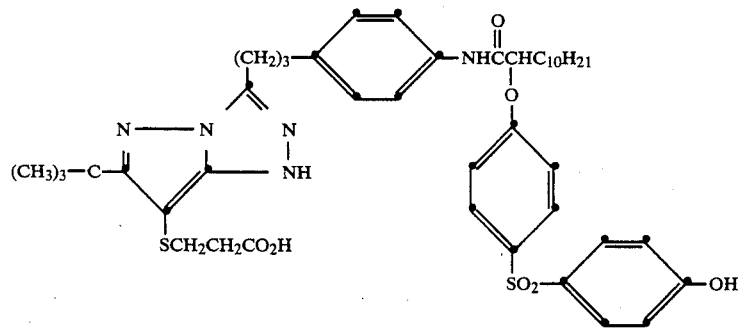
M-34
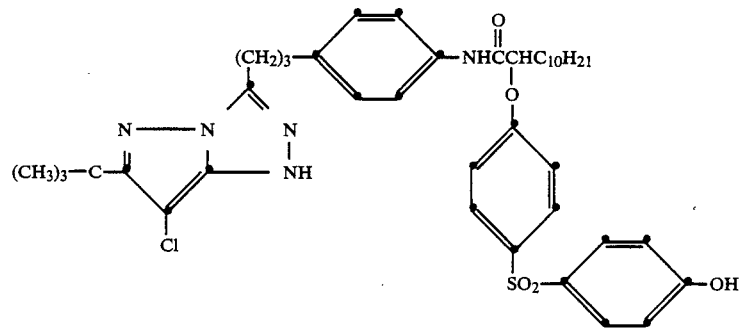

-continued
M-35
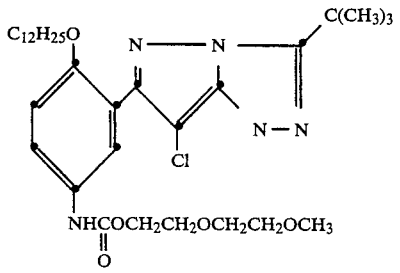
M-36
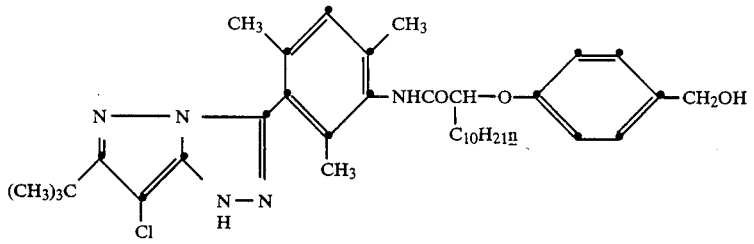
M-37
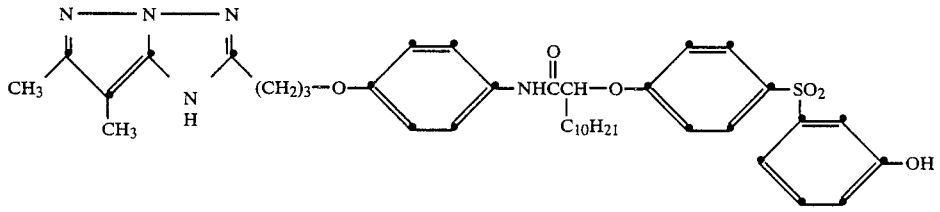
M-38
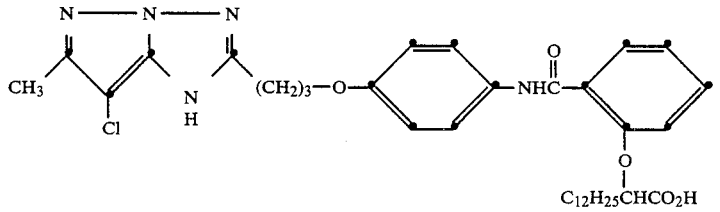
M-39
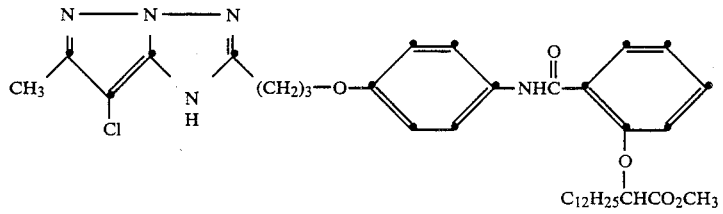
M-40
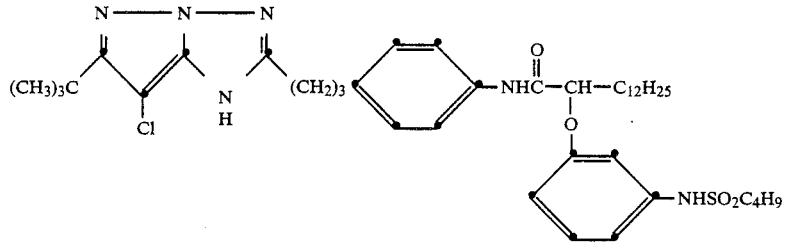

-continued

M-41

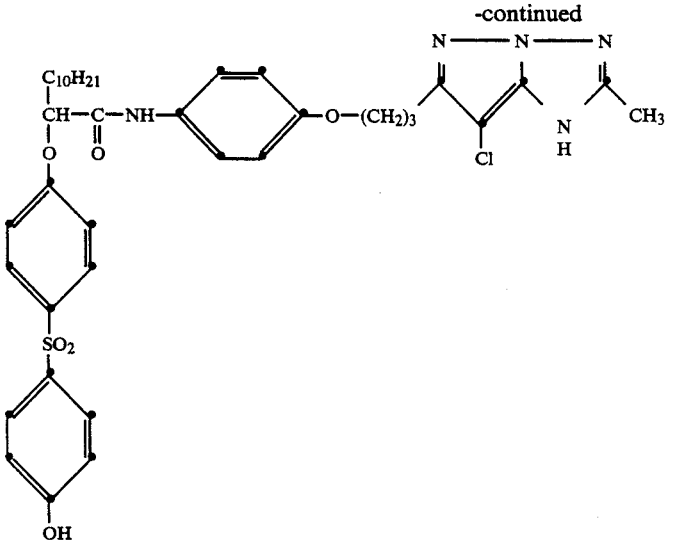

Couplers which form yellow dyes upon reaction with oxidized color developing agent are described in such representative U.S. Pat. Nos. as 2,298,443; 2,875,057, 2,407,210; 3,265,506; 3,384,657; 3,408,194; 3,415,652; 3,447,928; 3,542,840; 4,046,575; 3,894,875; 4,095,983; 4,182,630; 4,203,768; 4,221,860; 4,326,024; 4,401,752; 4,443,536; 4,529,691; 4,587,205; 4,587,207 and 4,617,256 the disclosures of which are incorporated herein by reference.

Preferred yellow dye image forming couplers are acylacetamides, such as benzoylacetanilides and pivalylacetanilides. Structures of such preferred coupler moieties are:

Y-1

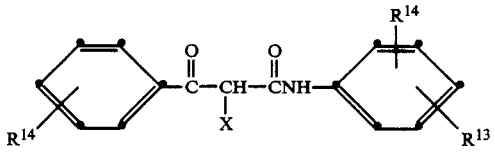

Y-2

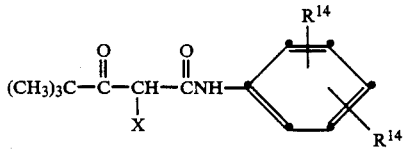

where $R^{13}$ is as defined above, $R^{14}$ is hydrogen or one or more halogen, lower alkyl (e.g. methyl, ethyl) or a ballast (e.g. alkoxy of 16 to 20 carbon atoms) group and X is a coupling off group.

Photographic elements in which the photographic couplers of this invention are incorporated can be simple elements comprising a support and a single silver halide emulsion layer, or they can be multilayer, multicolor elements. The coupler compounds of this invention can be incorporated in the silver halide emulsion layer or in another layer, such as an adjacent layer, where they will come into reactive association with oxidized color developing agent which has developed silver halide in the emulsion layer. The silver halide emulsion layer can contain, or have associated therewith other photographic coupler compounds, such as color forming couplers, colored masking couplers, etc. These other photographic coupler compounds can form dyes of the same or different color and hue as the photographic coupler compounds of this invention. Additionally, the silver halide emulsion layer can contain addenda conventionally contained in such layers.

A typical multilayer, multicolor photo graphic element according to this invention comprises a support having thereon a red sensitive silver halide emulsion layer having associated therewith a cyan dye image forming coupler compound, a green-sensitive silver halide emulsion layer having associated therewith a magenta dye image forming coupler compound and a blue sensitive silver halide emulsion layer having associated therewith a yellow dye image forming coupler compound, wherein at least one of the dye image forming coupler compounds has associated therewith a sulfonamide compound as described herein. Each silver halide emulsion layer can be composed of one or more layers and the layers can be arranged in different locations with respect to one another. Typical arrangements are described in U.S. Pat. Nos. 3,227,554; 3,620,747; 3,843,369; and 4,400,463 and in U.K. Pat. No. 923,045.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative working or direct positive emulsions. They can form latent images predominantly on the surface of the silver halide grains or predominantly on the interior of the silver halide grains. They can be chemically and spectrally sensitized. The emulsions typically will be gelatin emulsions although other hydrophilic colloids can be used in accordance with usual practice.

The support can be of any suitable material used with photographic elements. Typically, a flexible support is employed, such as a polymeric film or paper support. Such supports include cellulose nitrate, cellulose acetate, polyvinyl acetal, polyethylene terephthalate, polycarbonate and resinous materials as well as glass, paper or metal. Paper supports can be acetylated or coated with baryta and/or an α-olefin polymer, particularly a polymer of an α-olefin containing 2 to 10 carbon atoms such as polyethylene, polypropylene or ethylene butene copolymers.

Further details regarding silver halide emulsions and elements, and addenda incorporated therein can be found in *Research Disclosure*, December 1971, Item 9232, paragraphs I through XVIII. *Research Disclosure* is published by Industrial Opportunities Ltd., Homewell, Havant, Hampshire, PO9 1EF, United Kingdom.

The terms "in association" or "associated with" are intended to mean that materials can be in either the same or different layers, so long as the materials are accessible to one another.

The following examples further illustrate the invention. Unless otherwise indicated all parts, percents and ratios are by weight.

EXAMPLE I

Photographic elements employing coupler chemistry to show hue shifting with a 1-aryl-3-anilino-5-pyrazolone coupler and various sulfonamide compounds were prepared by coating on a paper support a silver chlorobromide emulsion layer (15 mole % chloride) comprising green sensitized 0.3 μm grains (0.42 gAg/m$^2$). Each layer also contained gelatin (1.6 g/m$^2$) and the magenta coupler M-1 (0.52 g/m$^2$) as described above, dispersed in the coupler solvent di-n-butylphthalate (DBp) (0.52 g/m$^2$ when used alone) or in combination with DBp and a sulfonamide compound (SC), each at 0.26 g/m$^2$ as described below in Table I.

Each coating was exposed imagewise through a graduated density test object to provide a maximum density image and was processed at 33° C employing the color developer solution described below, and then subjected to 1.5 minutes in the bleach-fix bath described below, washed and dried.

| | |
|---|---|
| Color Developer (pH 10.08) | |
| Triethanolamine | 11 mL |
| Benzyl alcohol | 14.2 mL |
| Lithium chloride | 2.1 g |
| Potassium bromide | 0.6 g |
| Hydroxylamine sulfate | 3.2 g |
| Potassium sulfite (45% solution) | 2.8 mL |
| 1-Hydroxyethylene-1,1-diphosphoric acid (60%) | 0.8 mL |
| 4-Amino-3-methyl-N-ethyl-N-β-methanesulfonamido)ethylaniline sulfate hydrate | 4.35 g |
| Potassium carbonate | 28 g |
| (anhydrous) | 28 g |
| Water to make | 1.0 liter |
| Bleach Fix Bath (pH 6.8) | |
| Ammonium thiosulfate | 104 g |
| Sodium hydrogen sulfite | 13 g |
| Ferric ammonium ethylenediamine tetra- | 65.6 g |

-continued

| | |
|---|---|
| acetic acid | |
| Ethylenediamine tetraacetic acid | 6.56 g |
| Ammonium hydroxide (28) | 27.9 mL |
| Water to make | 1 liter |

Transmission density versus wavelength data were obtained to determine the λmax of the dye in an environment with the addition of different sulfonamide compounds. Results are recorded in Table I which reflects the coupler: DBP: sulfonamide compound (SC) ratio used in each test.

TABLE I

| Sulfonamide Compound | Weight Ratio Coupler:DBP:SC | λmax, ηm |
|---|---|---|
| None (control) | 2:2:0 | 540 |
| 1 | 2:1:1 | 542 |
| 7 | 2:1:1 | 542 |
| 11 | 2:1:1 | 542 |
| 13 | 2:1:1 | 544 |
| 14 | 2:1:1 | 543 |

As is demonstrated by the data in Table I, hue shifts are highly subtle and vary only a few nanometers from the control when using sulfonamide compounds as described herein. These variations in wavelength shifts offer a high degree of manipulative control and provide an excellent, inexpensive means to obtain particularly desired hue values.

EXAMPLE 2—Tests using preformed dyes.

A solution of 6.25% photographic grade gelatin and 0.2% duPont Alkanol XC were added to each solution of preformed dye in 1 ml ethyl acetate with coupler solvent di n butylphthalate (DBp) or sulfonamide compound (SC) or a mixture of DBp and SC. The dyes and the sulfonamide compounds are described below. The amounts used of each are shown in Table II.

This mixture was passed five times through a colloid mill and 0.2 ml (10% solution) Olin Corp. 10G surfactant and 0.05 ml (5.0% solution) formaldehyde were added. The milled mixture was then coated on a poly(ethyleneterephthalate) support, 100 μm wet thickness, and dried at 49° C. After 24 hours, the coating was washed for 5 minutes, dried, and spectrophotometric absorption maxima values were obtained.

Table II shows that sulfonamide compounds as described herein, are capable of shifting the absorption maxima of dyes derived from dye-forming couplers to usefully longer wavelengths. The extent of hue shifting depends upon the specific dye and fulfonamide compounds used and also varies with the dye: sulfonamide compound ratio. The Table reflects the Dye:DBP:sulfonamide compound (SC) ratio used in each test.

TABLE II

| Dye Compound* | Sulfonamide Compound(SC) | Weight Ratio Dye:DBP:SC | λ-max, nm |
|---|---|---|---|
| A | none (control) | 11:3:0 | 532 |
| A | 1 | 1:2:1 | 535 |
| A | 1 | 1:0:3 | 539 |
| A | 2 | 1:2:1 | 533 |
| B | none (control) | 1:3:0 | 533 |
| B | 1 | 1:0:3 | 543 |
| C | none (control) | 1:3:0 | 639 |
| C | 1 | 1:2:1 | 645 |
| C | 1 | 1:0:3 | 653 |

TABLE II-continued

| Dye Compound* | Sulfonamide Compound(SC) | Weight Ratio Dye:DBP:SC | λ-max, nm |
|---|---|---|---|
| C | 2 | 1:2:1 | 644 |

As is demonstrated by the data in Table II, hue shifts to longer wavelengths, varying from a few nanometers to as much as 14 nanometers, are possible with sulfonamide compounds as described herein. These variations in wavelength shifts offer a high degree of manipulative control and provide an excellent, inexpensive means to obtain particularly can be effected within the spirit and scope of the invention.

What is claimed is:

1. A color photographic recording material comprising a support having thereon a light-sensitive silver halide emulsion layer, a dye image-forming coupler capable of forming a dye of reaction with oxidized color developing agent and, associated with the coupler, a sulfonamide compound which is capable of altering the spectral absorption of a dye formed from the coupler, said sulfonamide compound has the structural formula:

$R^1SO_2NHS^2$

*Dye Compounds:

A.

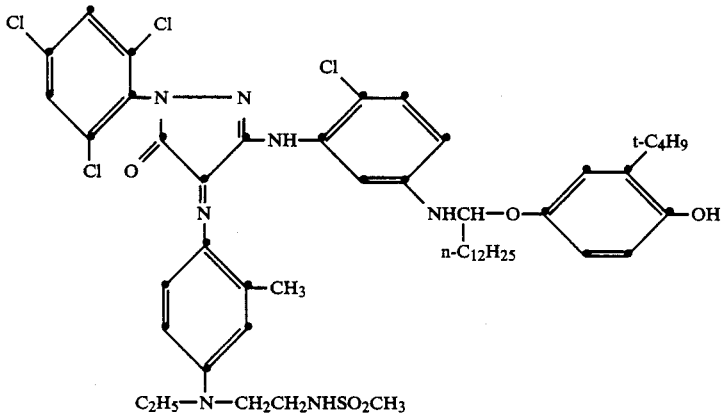

B.

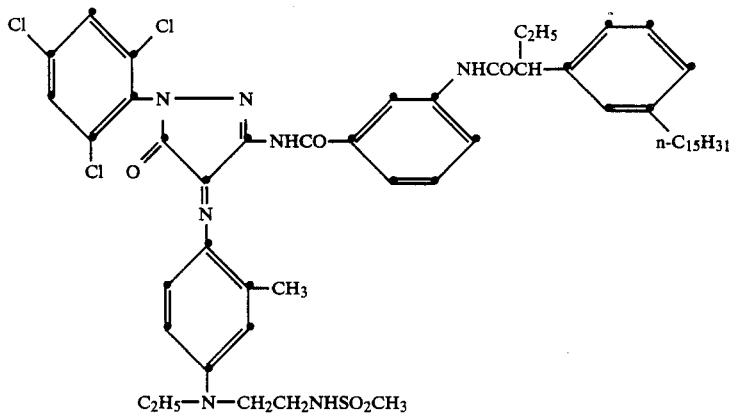

C.

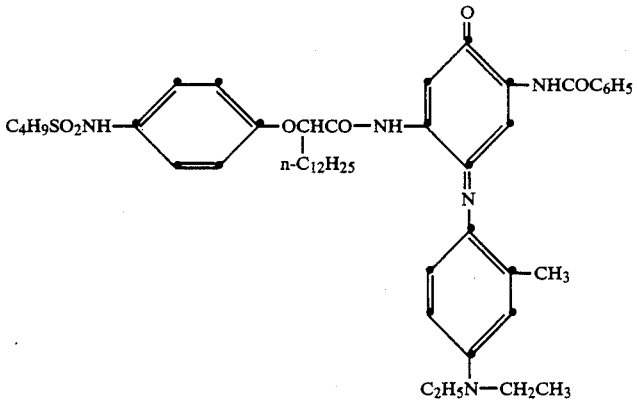

This invention has been described in detail with particular reference to preferred embodiments thereof, but it will be understood that variations and modifications wherein:

$R^1$ and $R^2$ unsubstituted alkyl having from 1 to about 12 carbon atoms, alkyl substituted with hydroxy, halogen or $—SO_2R^3$ or phenyl which is unsubstituted or substituted with halogen, alkyl, or haloalkyl where alkyl has from 1 to about 4 carbon atoms or with sulfamoyl having the formula $—SO_2NHR^3$, where $R^3$ is alkyl of from 1 to about 12 carbon atoms, wherein at least one of $R^1$ or $R^2$ is phenyl and wherein at least one of $R^1$ or $R^2$ is an alkyl group having from 1 to 12 carbon atoms.

2. A color photographic record comprising a dye formed by a coupling reaction between a dye image-forming coupler and oxidized silver halide developing agent, which recording material comprises, in association with the dye, a sulfonamide compound having the structural formula:

$$R^1SO_2NHR^2$$

wherein:

$R^1$ and $R^2$ are unsubstituted alkyl having from 1 to about 12 carbon atoms, alkyl substituted with hydroxy, halogen or $—SO_2R^3$ or phenyl which is unsubstituted or substituted with halogen, alkyl or haloalkyl where alkyl has from 1 to about 4 carbon atoms or with sulfamoyl having the formula $—SO_2NHR^3$, where $R^3$ is alkyl of from 1 to about 12 carbon atoms, wherein at least one of $R^1$ or $R^2$ is phenyl and wherein at least one of $R^1$ or $R^2$ is an alkyl group having from 1 to 12 carbon atoms.

3. A photographic recording material according to claim 1 wherein at least one of $R^1$ and $R^{2k}$ comprises a halogen substituent.

4. A photographic recording material according to claim 3 wherein the halogen is chlorine.

5. A photographic recording material according to claim 1 wherein the sulfonamide compound is present in an amount of from about 0.05 to about 5 parts by weight of coupler compound.

6. A photographic recording material according to claim 5 wherein the sulfonamide compound is present in an amount of from about 0.3 to about 3 parts by weight of coupler compound.

7. A photographic recording material according to claim 1 wherein the sulfonamide compound has the structural formula:

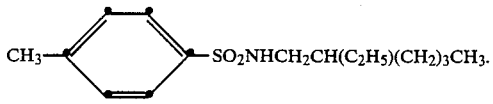

8. A photographic recording material according to claim 1 wherein the sulfonamide compound has the structural formula:

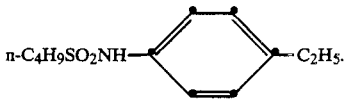

9. A photographic recording material according to claim 1 wherein the sulfonamide compound has the structural formula:

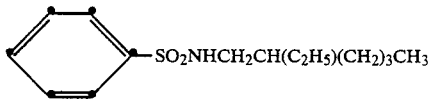

10. A photographic recording material according to claim 1 wherein the sulfonamide compound has the structural formula:

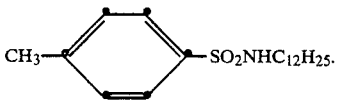

11. A photographic recording material according to claim 1 wherein the sulfonamide compound has the structural formula:

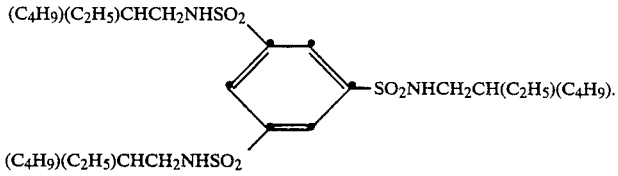

12. A photographic recording material according to claim 1 wherein the dye image-forming coupler is a magenta coupler.

13. A photographic recording material according to claim 1 wherein the dye image-forming coupler is a cyan coupler.

14. A photographic record according to claim 2 wherein the dye is formed from a cyan coupler compound.

15. A photographic record according to claim 2 wherein the dye is formed from a magenta coupler compound.

16. A photographic record according to claim 15 wherein the dye is formed from a pyrazolone magenta coupler compound.

17. A photographic record according to claim 15 wherein the dye is formed from a pyrazolotriazole magenta coupler compound.

18. A photographic record according to claim 15 wherein the dye is formed from a pyrazolobenzimidazole magenta coupler compound.

19. A photographic record according to claim 15 wherein the dye is formed from a indazole magenta coupler compound.

* * * * *

UNITED STATES PATENT AND TRADEMARK OFFICE

CERTIFICATE OF CORRECTION

PATENT NO. :4,973,535

DATED :November 27, 1990

INVENTOR(S) :Merkel et al

It is certified that error appears in the above-identified patent and that said Letters Patent is hereby corrected as shown below:

Column 2, line 56, "food" should read -good-; line 62, "procedures of the formula" should read --procedures well known in the--. Column 6, line 46, "p cyanophenyl" should read -- p-cyanophenyl--. Column 8, line 19, that part of formula reading "pyrazolo [1,5 a]" should read -- pyrazolo-[1,5-a] --; line 20, "3 position" should read -- 3-position --; line 22, that part of formula reading "pyrazolo [1,5 a]" should read -- pyrazolo-[1,5-a] --; line 37, "-=$NR^{13}$" should read -- -N=$NR^{13}$ --. Columns 23-24, that part of coupler compound M37 reading

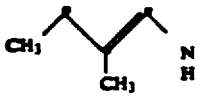

should read

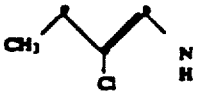

Column 28, line 5, "(28)" should read --(28%)--; line 17, "ηm" should read --nm--; line 54, "fulfonamide" should read -- sulfonamide--; line 61, "11:3:0" should read --1:3:0--. Column 30, line 7, "of reaction" should read --by reaction--. Column 31, line 1, after $R^2$, --are-- should be inserted.

Signed and Sealed this

Nineteenth Day of May, 1992

*Attest:*

DOUGLAS B. COMER

*Attesting Officer*

*Acting Commissioner of Patents and Trademarks*